US012018436B2

(12) United States Patent
Larsson

(10) Patent No.: US 12,018,436 B2
(45) Date of Patent: Jun. 25, 2024

(54) PIGMENT-COATED BOARD HAVING IMPROVED PE ADHESION

(71) Applicant: Billerudkorsnas AB, Solna (SE)

(72) Inventor: Johan Larsson, Gavle (SE)

(73) Assignee: BILLERUDKORSNAS AB, Solna (SE)

( * ) Notice: Subject to any disclaimer, the term of this patent is extended or adjusted under 35 U.S.C. 154(b) by 994 days.

(21) Appl. No.: 16/604,831

(22) PCT Filed: Apr. 12, 2018

(86) PCT No.: PCT/EP2018/059375

§ 371 (c)(1),
(2) Date: Oct. 11, 2019

(87) PCT Pub. No.: WO2018/189283

PCT Pub. Date: Oct. 18, 2018

(65) Prior Publication Data

US 2020/0080263 A1 Mar. 12, 2020

(30) Foreign Application Priority Data

Apr. 12, 2017 (EP) ..... 17166265

(51) Int. Cl.
*D21H 19/58* (2006.01)
*D21H 19/38* (2006.01)
(Continued)

(52) U.S. Cl.
CPC ..... *D21H 19/58* (2013.01); *D21H 19/385* (2013.01); *D21H 19/40* (2013.01); *D21H 19/822* (2013.01);
(Continued)

(58) Field of Classification Search
CPC ..... D21H 19/385; D21H 19/40; D21H 19/58; D21H 19/822; D21H 23/22; D21H 27/10; D21H 27/30
See application file for complete search history.

(56) References Cited

U.S. PATENT DOCUMENTS 4,595,611 A * 6/1986 Quick ..... B65D 81/3446 220/573.1
6,139,938 A * 10/2000 Lingle ..... B32B 29/005 156/205

(Continued)

FOREIGN PATENT DOCUMENTS

WO WO2010114467 A1 10/2010
WO WO2016130751 A1 8/2016

*Primary Examiner* — Christopher M Polley
*Assistant Examiner* — Sathavaram I Reddy
(74) *Attorney, Agent, or Firm* — Stites & Harbison PLLC; Richard S. Myers, Jr.

(57) ABSTRACT

There is provided a coated paperboard comprising a base board having a top side provided with a pigment coating, which pigment coating comprises a pigment mixture, a binder and a rheology modifier, wherein: the pigment mixture comprises, by dry weight, 0-17% of clay, 60-90% of a first $CaCO_3$ pigment and 0-30% of a second $CaCO_3$ pigment, provided that the amount of clay and second $CaCO_3$ pigment combined is at least 10%; the $d_{50}$ of the first $CaCO_3$ pigment is 0.60-0.80μιτι and the $d_{98}$ of the first $CaCO_3$ pigment is at least 2.8μιτι; the $d_{50}$ of the second $CaCO_3$ pigment is 0.63±0.10μιτι and the $d_{75}$ of the second $CaCO_3$ pigment is less than 1.2μιτι; the binder comprises a styrene-butadiene copolymer or a styrene-acrylate copolymer; and the dry weight ratio of pigment to binder in the pigment coating is from 100:16 to 100:20.

26 Claims, 2 Drawing Sheets

(51) Int. Cl.

| | |
|---|---|
| ***D21H 19/40*** | (2006.01) |
| ***D21H 19/82*** | (2006.01) |
| ***D21H 23/22*** | (2006.01) |
| ***D21H 27/10*** | (2006.01) |
| ***D21H 27/30*** | (2006.01) |

(52) U.S. Cl.
CPC ..... *D21H 23/22* (2013.01); *D21H 27/10* (2013.01); *D21H 27/30* (2013.01)

(56) References Cited

U.S. PATENT DOCUMENTS

| | | | | |
|---|---|---|---|---|
| 6,740,373 | B1 | 5/2004 | Swoboda et al. | |
| 2008/0075869 | A1* | 3/2008 | Nelli | D21H 19/385 428/142 |
| 2016/0075159 | A1* | 3/2016 | Zeng, Jr. | B41M 5/5218 428/32.37 |
| 2017/0066270 | A1* | 3/2017 | Pal | B41M 5/5227 |

* cited by examiner

PIGMENT-COATED BOARD HAVING IMPROVED PE ADHESION

CROSS REFERENCE TO RELATED APPLICATIONS

This application is a § 371 National Phase Application of PCT/EP2018/059375 filed Apr. 12, 2018, which claims priority to EP17166265.3, filed Apr. 12, 2017.

TECHNICAL FIELD

The present disclosure relates to the field of pigment-coated paperboard.

BACKGROUND

In the field of paper packaging, print quality is often a desired property. The surface properties, such as the printing properties, of paper or paperboard may be improved by applying a pigment coating. In addition to the pigment, such a pigment coating often comprises a binder. An alternative or complementary way of improving surface properties is calendering.

SUMMARY

For some applications, the pigment-coated board is covered with a layer of polyethylene (PE) such that a laminate is formed. The purpose of the PE layer is normally to provide a barrier and/or to facilitate heat sealing when a package is formed from the laminate. When the laminate is used, it is important that the PE-layer adheres firmly to the pigment coating, i.e. that delamination is avoided.

It is thus an object of the present disclosure to provide a pigment-coated paperboard having improved PE adhesion and satisfactory printing properties.

The inventor has surprisingly found that if a high proportion of the pigment is $CaCO_3$ pigment and, in turn, a high proportion of the $CaCO_3$ pigment has a broad particle-size distribution (i.e. a relatively high amount of relatively small and relatively large particles), the PE adhesion is significantly improved. To obtain satisfactory printing properties, it is however necessary to include relatively small amounts of clay and/or $CaCO_3$ pigment having a more narrow particle-size distribution.

The inventor has also found that an increased amount of binder often improves the PE-adhesion, but may impair printability. For cost efficiency, it is also generally desired to keep the amount of binder low.

There is thus provided a coated paperboard comprising a base board having a top side provided with a pigment coating, which pigment coating comprises a pigment mixture, a binder and a rheology modifier, wherein:

- the pigment mixture comprises, by dry weight, 0-17% of clay, 60-90% of a first $CaCO_3$ pigment and 0-30% of a second $CaCO_3$ pigment, provided that the amount of clay and second $CaCO_3$ pigment combined is at least 10%;
- the $d_{50}$ of the first $CaCO_3$ pigment is 0.60-0.80 μm and the $d_{98}$ of the first $CaCO_3$ pigment is at least 2.8 μm, such as 2.9-4.0 μm, such as 2.9-3.5 μm;
- the $d_{50}$ of the second $CaCO_3$ pigment is between 0.53 and 0.73 μm and the $d_{75}$ of the second $CaCO_3$ pigment is less than 1.2 μm, such as 0.85-1.15 μm, such as 0.9-1.1 μm;

- the binder comprises a styrene-butadiene copolymer or a styrene-acrylate copolymer; and
- the dry weight ratio of pigment to binder in the pigment coating is from 100:16 to 100:20.

DESCRIPTION

The present disclosure provides a coated paperboard comprising a base board. The base board has a top side that is provided with a pigment coating, In one embodiment, the base board comprises at least two paper layers (typically 2-5 layers), such as at least three paper layers (typically 3-5 layers), wherein a top paper layer of the base board is provided with the pigment coating. The top paper layer of the base board is typically bleached. It may comprise titanium dioxide and/or calcined clay and/or calcium carbonate as filler. The top layer is preferably formed from Kraft pulp, such as bleached Kraft pulp.

The grammage according to ISO 536 of the base board may for example be between 30 and 400 g/m$^2$, e.g. between 120 and 300 g/m$^2$, such as between 125 and 260 g/m$^2$.

The base board is preferably hydrophobized from a sizing agent treatment, such as treatment with alkyl ketene dimer (AKD), alkenyl succinic anhydride (ASA) or a combination thereof.

The pigment coating comprises:

- a pigment mixture;
- a binder; and
- a rheology modifier.

The pigment mixture comprises, by dry weight:

- 0-17%, such as 7-17%, preferably 9-14%, of clay;
- 60-90%, preferably 65-85%, more preferably 65-75%, of a first $CaCO_3$ pigment; and
- 0-30%, preferably 5-25% or 10-30%, more preferably 12-25% of a second $CaCO_3$ pigment.

Further, the amount of clay and second $CaCO_3$ pigment combined has to be at least 10%.

The clay is preferably kaolin clay, such as delaminated kaolin clay.

In one embodiment, the pigment mixture comprises, by dry weight, 7-17% of clay, 65-85% of the first $CaCO_3$ pigment and 5-25% of the second $CaCO_3$ pigment, which means that the amount of clay and second $CaCO_3$ pigment combined is at least 12%

In another embodiment, the pigment mixture comprises, by dry weight, 65-85% of the first $CaCO_3$ pigment and 15%-35% of the second $CaCO_3$ pigment, but no clay.

Figure 1:
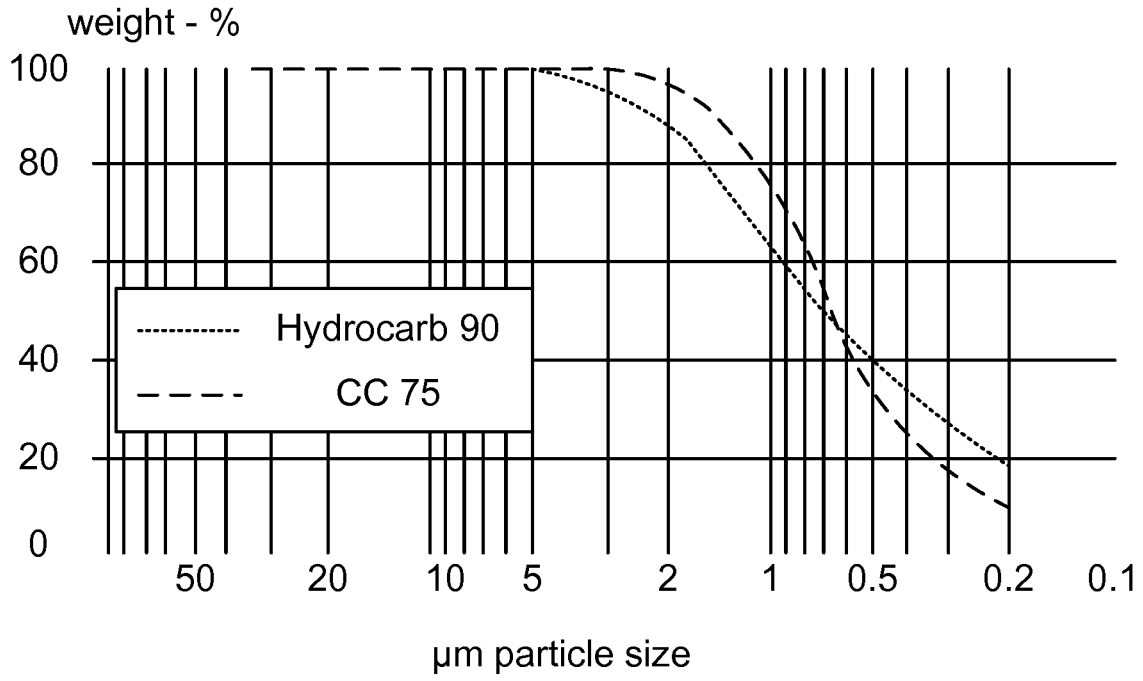
FIG. 1 shows the (narrow) particle size distribution for Covercarb 75 (CC75) from OMYA and the (broad) particle size distribution for Hydrocarb 90 from OMYA.

The first and the second $CaCO_3$ pigment have different particle size distributions. The distribution of the first $CaCO_3$ pigment is broader than the distribution of the second $CaCO_3$ pigment (which is exemplified in FIG. 1).

The $d_{50}$ of the first $CaCO_3$ pigment is 0.60-0.80 μm, preferably 0.65-0.75 μm. The $d_{98}$ of the first $CaCO_3$ pigment is at least 2.8 μm, such as 2.9-4.0 μm, such as 2.9-3.5 μm or 3.0-3.4 μm.

The $d_{50}$ of the second $CaCO_3$ pigment is 0.63 μm±0.10 μm, preferably 0.63 μm±0.05 μm. The $d_{75}$ of the second $CaCO_3$ pigment is less than 1.2 μm, such as 0.9-1.1 μm. The $d_{98}$ of the second $CaCO_3$ pigment is preferably below 3 μm, such as 2.3±0.30 μm, such as 2.3±0.20 μm.

The skilled person working with calcium carbonate pigments is familiar with d values. For determining the d values, a Sedigraph 5100 or 5120 device from the company Micromeritics, USA, can be used. The particle size distributions given herein were determined using a Micromeritics Sedigraph III with software version V.1.04.

Preferably, the first and the second $CaCO_3$ pigment are both ground calcium carbonate (GCC).

The binder comprises a styrene-butadiene copolymer or a styrene-acrylate copolymer. The styrene-acrylate copolymer binder is preferred due to lesser health and environmental concerns.

The dry weight ratio of pigment to binder in the pigment coating is in the range from 100:16 to 100:20, preferably from 100:16 to 100:19, roughly corresponding to a dry weight % within the range of about 13-17 wt % of binder in the pigment-binder mixture. When the binder comprises a styrene-acrylate copolymer, the dry weight ratio is preferably in the range from 100:16 to 100:20, preferably from 100:16 to 100:19.

The glass transition temperature (Tg) of the binder is preferably between 3° C. and 25° C., e.g. between 15 and 25° C., such as between 20 and 22° C.

Accordingly, pigment preferably amounts to 83-87%, such as 84.5-86.5% of the dry weight of the pigment coating. The binder preferably amounts to 13.8-16.7%, such as 14.0-15.3% of the dry weight of the pigment coating.

The rheology modifier typically amounts to 0.05-2.0%, such as 0.1-1.0%, of the dry weight of the pigment coating. The rheology modifier may for example be CMC or an acrylic co-polymer, such as an alkali-swellable emulsion (ASE) or a hydrophobically modified, alkali-swellable emulsion (HASE).

The coat weight of the pigment coating on the top side is preferably 5-30 g/m$^2$, such as 6-25 m$^2$, such as 7-22 m$^2$, such as 8-20 g/m$^2$.

A pre-coating layer comprising pigment and a binder may be provided between the top side of the base board and the pigment coating.

A reverse side of the base board may be provided with a reverse side pigment coating, which optionally has the same composition as the top side pigment coating. The coat weight of the reverse side pigment coating may for example be 1-30 g/m$^2$, such as 5-25 m$^2$, such as 7-22 m$^2$, such as 8-20 g/m$^2$.

There is also provided a method of producing a coated paperboard, comprising applying a pigment coating composition on a top side of a base board, which top side is optionally coated with a pre-coating, characterized in that the pigment coating composition comprises the components defined above.

There is also provided a use of a coated paperboard according to the above for producing a package, such as a package for food or liquids.

EXAMPLES

Trial 1

Paperboard was coated with different pigment coating compositions (see table 1).

Components of the coating compositions were:

Kaolux HS ("Clay"), kaolin clay from Thiele having a brightness (GE) of 90, a particle size of 84%<2 μm, 69%<1 μm and median (d50) 0.75 μm, and an aspect ratio of 14;

Hydrocarb 90 ("HC90"), $CaCO_3$ pigment from Omya: broad particle size distribution, $d_{50}$=0.7 μm, $d_{75}$=1.2 μm and $d_{98}$=3.2 μm;

Covercarb 75 ("CC75"), $CaCO_3$ pigment from Omya: narrow particle size distribution, $d_{50}$=0.63 μm, $d_{75}$=1 μm and $d_{98}$=2.30 μm;

Styrene-acrylate latex ("Latex")

The paperboard was then printed and the STFI mottle (for cyan) and the Printing density were measured (see table 1).

TABLE 1

The components of the respective compositions are given as parts by dry weight. All compositions also included the same rheology modifier.

| Sample | Clay (parts) | HC90 (parts) | CC75 (parts) | Latex (parts) | STFI mottle | Printing density |
|---|---|---|---|---|---|---|
| 1 | 20 | 40 | 40 | 17 | 1.00 | 1.41 |
| 2 | 10 | 60 | 30 | 17 | 1.11 | 1.41 |
| 3 | 10 | 70 | 20 | 17 | 1.04 | 1.42 |
| 4 | 10 | 80 | 10 | 17 | 1.12 | 1.39 |
| 5 | 10 | 90 | 0 | 17 | 1.17 | 1.37 |
| 6 | 10 | 70 | 20 | 15 | 1.01 | 1.40 |
| 7 | 10 | 80 | 10 | 15 | 1.00 | 1.41 |
| 8 | 10 | 90 | 0 | 15 | 1.08 | 1.40 |
| 9 | 10 | 90 | 0 | 13 | 0.93 | 1.41 |
| 10 | 10 | 70 | 20 | 19 | 1.15 | 1.40 |
| 11 | 30 | 60 | 10 | 19 | 1.65 | 1.40 |

Sample 1 was included as a reference sample known to provide satisfactory printing properties. For the STFI mottle, a general rule of thumb is that a difference of 0.03 is detectable by an experienced eye, while a difference of 0.05 is detectable by an average consumer.

The inventor has found that the use of a relatively high proportion of $CaCO_3$ pigment (and thus a relatively low proportion of clay pigment) in the pigment mixture improves the PE adhesion. The inventor has also found that $CaCO_3$ pigment having a broad particle size distribution, such as HC90, results in a particular improvement of the PE adhesion. However, Table 1 shows that if only HC90 is used as the $CaCO_3$ pigment (sample 5), a relatively high STFI mottle is obtained. If ten parts of HC90 is replaced by CC75 (sample 4), the STFI print mottle is decreased. If another ten parts of HC90 is replaced by CC75 (sample 3), such that a 70:20 weight ratio is obtained between the two types of $CaCO_3$ pigment, the STFI print mottle is further decreased. Surprisingly, the STFI mottle increases again if yet another ten parts of HC90 is replaced by CC75 (sample 2).

The inventor has also found that a higher amount of binder generally results in better PE adhesion. More than 15 parts of binder is necessary for a satisfactory result. However, a comparison of samples 10 and 3 in table 1 shows that it may be preferred to have less than 19 parts of binder, at least when the binder is a styrene-acrylate copolymer, when STFI mottle is considered.

Trial 2

Paperboard was coated with a pre-coating and various top coatings.

Components of the coating compositions were:

Kaolux G ("Clay"), kaolin clay from Thiele having a brightness (GE) of 90 and a particle size of 80-85%<2 μm;

Covercarb 75 ("CC75"), $CaCO_3$ pigment from Omya: narrow particle size distribution, $d_{50}$=0.63 μm, $d_{75}$=1 μm and $d_{98}$=2.30 μm;

Hydrocarb 90 ("HC90"), $CaCO_3$ pigment from Omya: broad particle size distribution, $d_{50}$=0.7 μm, $d_{75}$=1.2 μm and $d_{98}$=3.2 μm;

Styrene-acrylate latex ("Latex"), Styron SA 95085.01;

Rheology modifier ("Rheo"), Coatex Rheocoat 66 (an acidic emulsion of acrylic copolymer)

The paperboard was then coated with polyethylene (PE) and Fmax and Favg (the maximum force and the average force determined from a peel test), which represent PE adhesion, was measured. The method of measuring Fmax and Favg is described in more detail below. The top coating compositions and the resulting F values are presented in Table 2.

For all samples, the pre-coating composition consisted of 20 parts of Clay, 80 parts of HC60, 14 parts of Latex and 0.26 parts of Rheo. The viscosity of the pre-coating was about 1400 mPas and its dry matter content was about 65%. The coat weight of the pre-coating was 8.5 g/m$^2$.

The viscosity of the top coatings was about 1300 mPas and their dry matter content was about 63%. The coat weight of the top coatings was 11.5 g/m$^2$.

TABLE 2

| | Sample | | | | | | |
|---|---|---|---|---|---|---|---|
| | 1 | 2 | 3 | 4 | 5 | 6 | 7 |
| Clay (parts) | 20 | 10 | 10 | 10 | 10 | 10 | |
| CC75 (parts) | 40 | 20 | 20 | 20 | 20 | 20 | 25 |
| HC90 (parts) | 40 | 70 | 70 | 70 | 70 | 70 | 75 |
| Latex (parts) | 17 | 21 | 19 | 17 | 15 | 13 | 17 |
| Ratio* | 100:17 | 100:21 | 100:19 | 100:17 | 100:15 | 100:13 | 100:17 |
| Rheo (parts) | 0.28 | 0.28 | 0.28 | 0.28 | 0.28 | 0.28 | 0.28 |
| Fmax | 1.28 | 1.53 | 1.87 | 2.13 | 1.31 | 0.88 | 3.80 |
| Favg | 1.21 | 1.43 | 1.72 | 2.01 | 1.24 | 0.84 | n/a§ |

| | Sample | | | | | |
|---|---|---|---|---|---|---|
| | 8 | 9 | 10 | 11 | 12 | 13 |
| Clay (parts) | 30 | 20 | 10 | 70 | 10 | 10 |
| CC75 (parts) | | 15 | 30 | | 10 | |
| HC90 (parts) | 70 | 65 | 60 | 30 | 80 | 90 |
| Latex (parts) | 17 | 17 | 17 | 17 | 17 | 17 |
| Ratio* | 100:17 | 100:17 | 100:17 | 100:17 | 100:17 | 100:17 |
| Rheo (parts) | 0.28 | 0.28 | 0.28 | 0.28 | 0.28 | 0.28 |
| Fmax | 1.20 | 1.49 | 1.84 | 0.66 | 1.87 | 2.02 |
| Favg | 1.15 | 1.42 | 1.75 | 0.63 | 1.77 | 1.90 |

*Dry weight ratio of pigment to binder

§No mean value (Favg) is reported for sample 7. For this sample, the force was very high and uneven across the 15 mm length that was measured, and there was no way to produce a meaningful mean value according to the method employed. The maximum value (Favg) is however relevant and shows that the force needed to separate the PE film from the coated paperboard surface was very high.

Table 2 shows that decreasing the amount of latex from 21 parts (sample 2) to 19 parts (sample 3), increased Fmax from a relatively low level (1.53) to a satisfactory level (1.87). A further decrease of the amount of latex to 17 parts (sample 4) resulted in a significant increase of the Fmax to a particularly high level (2.13). At 15 parts (sample 5), Fmax was again below a satisfactory level and at 13 parts (sample 6), Fmax was even lower than at 15 parts. Trial 2 thus supports that the amount of latex should be from 16-20 parts, that 16-19 parts of latex is a preferred range and that 16-18 parts of latex is an even more preferred range.

Table 2 also shows that the samples having 60-90 parts of HC90 and less than 20 parts of clay resulted in satisfactory PE adhesion properties when the proportion of binder (Latex) was 17 or 19 parts. In contrast, the samples having less than 60 parts of HC90 and/or 20 or more parts of clay resulted in inferior PE adhesion properties.

Method of Measuring PE Adhesion

Poor adhesion of extruded PE to a pigment-coated paper board is almost always caused rupture in the pigment-coating layer, at least for weaker coatings. Hence, "coating layer cohesion" may be a more correct terminology than "PE adhesion". The method below is designed to determine how well a final product, such as a liquid package, performs when subjected to mechanical stress by measuring the cohesion of the coating layer. The instrument used for the method is made by Instron, but any quality tensile tester will suffice.

Figure 2:
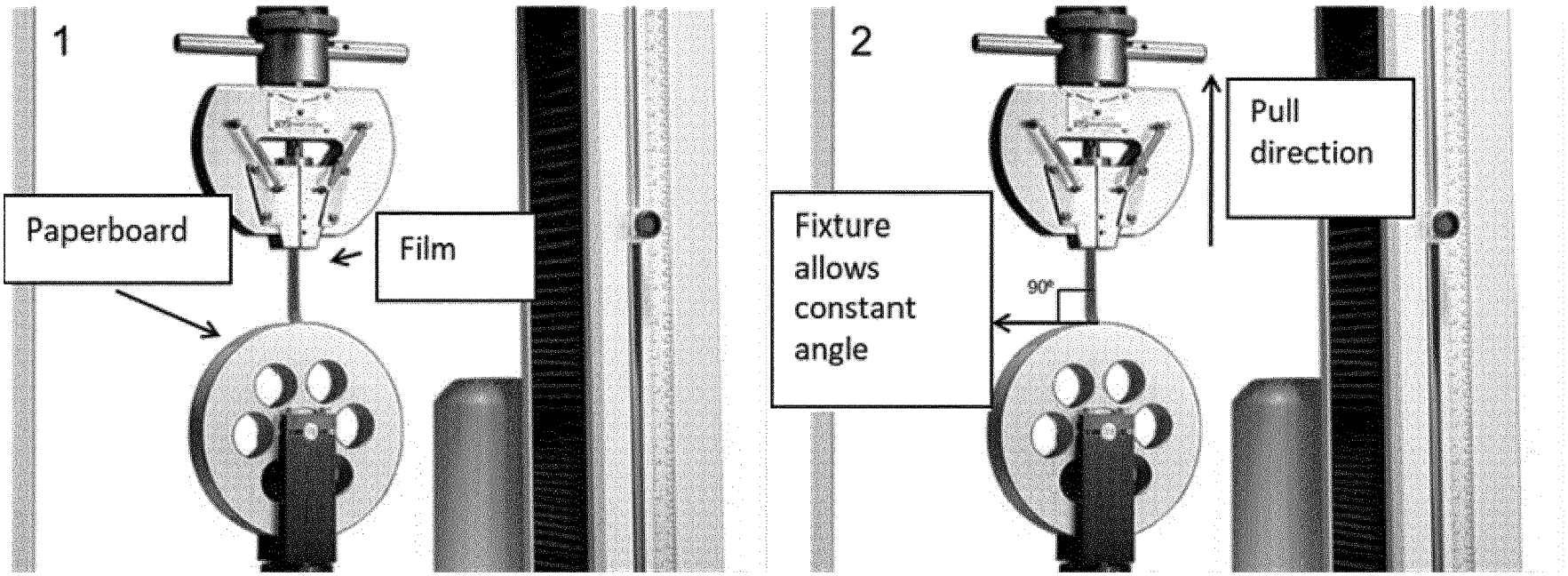
FIG. 2 illustrates the set-up for measuring PE adhesion used in Trial 2.

1. One extrusion coated sample, 50-100 cm×web width is sampled from production.
2. Gently make a cut in the PE film in the cross direction (CD), relative to the production direction (MD).
3. Separate by hand the PE film from the paperboard along the cut.
4. Cut samples 15 mm*15 cm so that you get the delaminated film in the one end (15 mm CD and 15 cm MD)
5. Place the samples one at the time onto the wheel, as depicted in FIG. 2, with double adhesive tape 3M 410 and release the film to the clamp. The wheel moves during the measurement to always secure 90° angle. In case of very high values for delamination the film may stretch or rupture. This was the case here and so the Scotch Tape 371 PP clear was used on top of the PE to make it stronger and to only measure the adhesion force between the paper coating and the PE film and not stretch of the approximately 20 micron thick PE film.

6. Start pulling upwards with the Instron and record the force in N and extension in mm. Measure for 15 mm length, 4 times in MD and 4 times in anti MD.

7. Report the data as both a maximum within an error free area and a mean value of N/m between two points on the curve where the force is constant (Fmax and Favg, respectively). In this case, all data between 1.5 and 13.5 mm was considered, which means that the data from the first 10% and the last 10% of were ignored. Report the average of 8 samples whereof 4 is in MD and 4 in anti MD.

The invention claimed is:

1. A coated paperboard comprising a base board having a top side provided with a pigment coating, which pigment coating comprises a pigment mixture, a binder and a rheology modifier, wherein:

the pigment mixture comprises, by dry weight, 0-10% clay, 60-90% of a first $CaCO_3$ pigment and 5-25% of a second $CaCO_3$ pigment, provided that the amount of clay and second $CaCO_3$ pigment combined is at least 10%;

the d50 of the first $CaCO_3$ pigment is 0.60-0.80 μm and the d98 of the first $CaCO_3$ pigment is at least 2.8 μm;

the d50 of the second $CaCO_3$ pigment is between 0.53 and 0.73 μm and the d75 of the second $CaCO_3$ pigment is less than 1.2 μm;

the binder comprises a styrene-butadiene copolymer or a styrene-acrylate copolymer; and the dry weight ratio of pigment to binder in the pigment coating is from 100:16 to 100:20.

2. The coated paperboard according to claim 1, wherein the coat weight of the pigment coating on the top side is 5-30 $g/m^2$.

3. The coated paperboard according to claim 1, wherein the first and the second $CaCO_3$ pigment are ground calcium carbonate (GCC).

4. The coated paperboard according to claim 1, wherein the pigment mixture comprises, by dry weight, 7-10% clay, 65-85% of the first $CaCO_3$ pigment and 5-25% of the second $CaCO_3$ pigment.

5. The coated paperboard according to claim 1, wherein the pigment mixture comprises, by dry weight, 7-10% clay, 65-85% of the first $CaCO_3$ pigment and 12-25% of the second $CaCO_3$ pigment.

6. The coated paperboard according to claim 1, wherein the binder comprises a styrene-acrylate copolymer and the dry weight ratio of pigment to binder in the pigment coating is from 100:16 to 100:18.

7. The coated paperboard according to claim 1, wherein pigment amounts to 83-87% of the dry weight of the pigment coating and the at least one binder amounts to 13.8-16.0% of the dry weight of the pigment coating.

8. The coated paperboard material according to claim 1, wherein a pre-coating layer comprising pigment and a binder is provided between the top side of the base board and the pigment coating.

9. The coated paperboard according to claim 1, wherein the clay is kaolin clay.

10. The coated paperboard according to claim 1, wherein the base board comprises at least two paper layers, and wherein a top paper layer of the base board is provided with the pigment coating.

11. The coated paperboard according to claim 4 wherein the grammage according to ISO 536 of the base board is between 120 and 300 $g/m^2$.

12. The coated paperboard according claim 1, wherein a reverse side of the base board is provided with a reverse side pigment coating, which optionally has the same composition as the top side pigment coating.

13. The coated paperboard according to claim 1, wherein the rheology modifier amounts to 0.05-2.0% of the dry weight of the pigment coating.

14. The coated paperboard according to claim 1, wherein the rheology modifier is CMC or an acrylic co-polymer.

15. The coated paperboard of claim 1, wherein the d98 of the first $CaCO_3$ pigment is 2.9-4.0 μm; and the d75 of the second $CaCO_3$ pigment is 0.85-1.15 μm.

16. The coated paperboard according to claim 2, wherein the coat weight of the pigment coating on the top side is 6-25 $m^2$.

17. The coated paperboard according to claim 2, wherein the coat weight of the pigment coating on the top side is 7-22 $m^2$.

18. The coated paperboard according to claim 2, wherein the coat weight of the pigment coating on the top side is 8-20 $g/m^2$.

19. The coated paperboard according to claim 7, wherein pigment amounts to 84.5-86.5% of the dry weight of the pigment coating and the at least one binder amounts to 14.0-15.3% of the dry weight of the pigment coating.

20. The coated paperboard according to claim 11, wherein the grammage according to ISO 536 of the base board is between 125 and 260 $g/m^2$.

21. The coated paperboard according to claim 13, wherein the rheology modifier amounts to 0.1-1.0%, of the dry weight of the pigment coating.

22. The coated paperboard according to claim 14, wherein the rheology modifier is an alkali-swellable acrylate polymer.

23. The coated paperboard according to claim 9, wherein the kaolin clay is delaminated kaolin clay.

24. The coated paperboard according to claim 10, wherein the base board comprises at least three paper layers.

25. A method of producing a coated paperboard, comprising applying a pigment coating composition on a top side of a base board, which top side is optionally coated with a pre-coating, characterized in that the pigment coating composition comprises the components defined in claim 1.

26. The method of claim 25, further comprising forming the coated paperboard into a package for food or liquids.

* * * * *